US005564401A

United States Patent [19]

Dickson

[11] Patent Number: 5,564,401

[45] Date of Patent: Oct. 15, 1996

[54] CRANKCASE EMISSION CONTROL SYSTEM

[75] Inventor: Gary J. Dickson, Hampton Bays, N.Y.

[73] Assignee: Diesel Research Inc., Hampton Bays, N.Y.

[21] Appl. No.: 505,442

[22] Filed: Jul. 21, 1995

[51] Int. Cl.[6] ..... F02M 25/06

[52] U.S. Cl. ..... 123/573

[58] Field of Search ..... 123/572, 573, 123/574

[56] References Cited

U.S. PATENT DOCUMENTS

| | | | |
|---|---|---|---|
| 3,754,538 | 8/1973 | Ephraim et al. | 123/574 |
| 3,877,451 | 4/1975 | Lipscomb | 123/573 |
| 3,903,858 | 9/1975 | Hecht | 123/573 |
| 4,167,164 | 9/1979 | Bachmann | 123/573 |
| 4,370,971 | 2/1983 | Bush | 123/573 |
| 4,727,807 | 2/1988 | Walker | 123/196 |
| 5,201,301 | 4/1993 | Re | 123/573 |

OTHER PUBLICATIONS

Brochure describing "Crankvent" Crankcase Emission Control Systems distributed by Parker Hannifin Corporation, Racor Division.

*Primary Examiner*—Marguerite McMahon
*Attorney, Agent, or Firm*—Meltzer, Lippe, Goldstein, et al.

[57] ABSTRACT

A closed crankcase emission control assembly for an internal combustion engine incorporates into a single compact unit a pressure control assembly, a filter and an oil drain check valve. The pressure control assembly has a gate whereon oily contaminated crankcase emission impinge and oil is separated. The separated oil is collected in a reservoir and returned to the crankcase. The pressure control assembly also has a variable orifice agglomerator which agglomerates particles in the contaminated crankcase emission to form larger particles. Thus, the pressure control assembly simultaneously regulates pressure, separates oil and agglomerates particles. The agglomerated particles are filtered by a filter which may be coarse and clogs less often.

11 Claims, 14 Drawing Sheets

CRANKCASE EMISSION CONTROL SYSTEM

FIELD OF THE INVENTION

The present invention is directed to a crankcase emission control system for a heavy internal combustion engine, such as a diesel engine. More particularly, the crankcase emission control system of the present invention combines a pressure control assembly, an inertial separator/agglomerator and a filter into a single integral unit, which separates oil and agglomerates particulates and aerosols to form larger particulates and aerosols for better filtering.

BACKGROUND OF THE INVENTION

Emission controls for internal combustion engines have become increasingly important as concern over environmental damage and pollution have been increasing, prompting legislators to pass more stringent emission controls. Much progress has been made in improving exhaust emission controls. However, crankcase emission controls have been largely neglected.

Crankcase emissions result from gas escaping past piston rings of an internal combustion engine and entering the crankcase due to high pressure in the cylinders during compression and combustion. As the blow-by gas passes through the crankcase and out the breather, it becomes contaminated with oil mist. In addition to the oil moist, crankcase emissions also contain wear particles and air/fuel emissions. Only a small number of heavy diesel engines have crankcase emission controls. The majority of current production diesel engines discharge these crankcase emissions to the atmosphere through a draft tube or similar breather vent contributing to air pollution. Some of the crankcase emissions are drawn into the engine intake system causing internal engine contamination and loss of efficiency.

The released oily crankcase emissions coat engine sites, such as the inside of engine compartments or chambers, fouling expensive components and increasing costs, such as clean-up, maintenance and repair costs. As the oily residue builds up on critical engine components, such as radiator cores, turbocharger blades, intercoolers and air filters, it becomes a "magnet" for dust, grit and other airborne contaminants. Particulates in the contaminated oily crankcase emissions include particles and aerosols. The accumulation of the particulates on these components reduces efficiency, performance and reliability of the engine.

In addition to increasing engine performance and decreasing maintenance intervals and site/critical engine component contamination, crankcase emission controls are becoming increasingly important in reducing air pollution. Engine emissions include both crankcase and exhaust emissions. Because of reductions in exhaust emissions, the percentage of the total engine emissions due to crankcase emissions has risen. Therefore, reducing crankcase emissions provides a greater environmental impact with engines having low exhaust emissions.

Furthermore, most of the crankcase particulate emissions (CPE) are soluble hydrocarbons, as opposed to the exhaust emissions which are mainly insoluble organics. The crankcase particulate emissions are oil related, with ethylene ($C_2H_4$) being predominant. Therefore, separating the oil and returning the cleaned oil free crankcase emissions to the engine inlet for combustion increases engine efficiency.

Crankcase flow and particulate emissions increase dramatically with engine life and operating time. Thus, the environmental impact and engine efficiency from recycling the crankcase emissions increase with operating time. For example, in buses having diesel engines, the crankcase particulate emissions represent as much as 50% of the total exhaust particulate emissions.

Crankcase emission control systems filter the crankcase particulate emissions and separate the oil mist from the crankcase fumes. The separated oil is collected for periodic disposal or return to the crankcase.

Crankcase emission control systems may be "open" or "closed" systems. In open crankcase emission control systems, the cleaned gases are vented to the atmosphere. Such open systems are manufactured by Diesel Research, the assignee of the present application. Other open systems are "Emission Absorber/Ecovent" manufactured by Nelson Industries, "Oildex" manufactured in California, and "Condensator" manufactured in Colorado. Although open systems have been acceptable in many markets, they pollute the air by venting emission to the atmosphere and suffer from low efficiency. Closed systems eliminate crankcase emissions to the atmosphere, meet strict environmental regulations, and eliminate site and external critical component contamination.

In closed crankcase emission control systems, the cleaned gases are returned to the engine combustion inlet. "Airsep" by Walker Engineering is one such closed crankcase emission control system. Another closed system by Walker Engineering uses a canister type filter and a vacuum limiter. Other closed systems by Diesel Research include a two-component system which has a crankcase pressure regulator and a separate filter. In addition, "Oildex" and "Condensator" have also been used in closed systems.

Closed crankcase emission control systems require a high efficiency filter and crankcase pressure regulator. The high efficiency filter is required to filter out small sized particles to prevent contamination of turbochargers, aftercooler, and internal engine components. The pressure regulator maintains acceptable levels of crankcase pressure over a wide range of crankcase gas flow and inlet restrictions.

In a closed system, the crankcase breather is connected to the inlet of the closed crankcase emission control system. The outlet of the closed crankcase emission control system is connected to the engine air inlet, where the filtered blow-by gas is recycled through the combustion process.

FIG. 1*a* shows a prior art closed crankcase emission control system 100 disclosed in the U.S. Pat. No. 4,724,807 to Walker. The closed crankcase emission control system 100 comprises a vacuum limiter 110 and an in-line oil separator 120 that has a circular centrifugal pattern. A hose 125 interconnects the vacuum limiter 110, the separator 120, and a crankcase breather 130 which is located on a valve cover 135. The vacuum limiter 110 limits the crankcase and engine intake vacuum. This is achieved by venting the crankcase emissions to the atmosphere or pulling ambient air into the hose 125 through an air tube 145 connected to an air filter (not shown) that fits over the entire vacuum limiter 110. The venting to the atmosphere by the vacuum limiter 110, through the air tube 145 transforms the closed system 100 into an open system.

The separator 120 receives crankcase emissions from the hose 125 and clean air from a silencer filter 150. The separator 120 relies on a centrifugal pattern to separate oil from the crankcase emissions. The output from the separator 120 are cleaned crankcase emissions, which are provided to the combustion inlet of the engine, through the induction system or the turbo air intake 155 for turbo-charged engines. The exhaust manifold 160 and the turbocharger 162 (FIG 1*a*), for turbo-charged engines, are coupled to an exhaust 165. The separated oil drains back to the engine block 140 or the oil pan 170 through a drain hose 175 connected to the separator 120. A check valve 180, shown in FIG. 1*b*, is connected between the separator 120 and the oil pan 170. The check valve 180 allows oil to drain from the separator 120 and the oil pan 170 but prevents oil or gas flow in the opposite direction.

FIG. 1*b* is a block diagram representation of FIG. 1*a*. In FIG. 1*b*, as well as the remaining figures, identical elements are identically numbered. FIG. 1*b* shows the separator 120 connected to the turbo air intake 155 of a turbocharger system 190. The turbocharger system 190 includes a compressor 192, a turbocharger 194 and an aftercooler 196.

FIG. 2 shows the separator 120 in greater detail. The separator 120 has an annular housing 210 containing first, second and third baffles 220, 230, 240. The third baffle defines a channel 250. One end of the channel 250 is a primary gas inlet 260 connected to the silencer filter 150 for receiving ambient air. The other end of the channel 250 is a gas outlet 270. A secondary gas inlet 280 receives oil contaminated crankcase emissions from the crankcase breather 130, through the hose 125. The separator 120 separate oil from the crankcase emissions and outputs the cleaned crankcase emissions and the air from its primary gas inlet 260 through the gas outlet 270.

The separated oil drains through a drain coupling 290 which is connected to the engine block 140 or to the oil pan 170 through the check valve 180 and the drain hose 175 (FIGS. 1*a–b*).

FIG. 3 is a cross-section of the separator 120 showing its the centrifugal pattern, wherein the flow of crankcase emissions are shown by arrows 310. As shown in FIG. 3, baffles 220, 230, 240 are arranged so that there is no straight line flow path between the secondary inlet 280 and the outlet 270. As the oil contaminated crankcase emissions flow through the separator 120, the oil impacts and condenses or is adsorbed on the surfaces of the baffles 220, 230, 240. The cleaned crankcase emissions enter the channel 250 through an opening 310 of the third baffle 240. The cleaned air then exits the channel 250 through the outlet 270 and enters the intake air turbo 155, which then transports the air as usual.

FIG. 4 shows a block diagram of another closed crankcase emission control system 400 comprising a filter/separator 410, a control valve 415 which regulates pressure in the crankcase. The filter/separator 410 incorporates the check valve 180, shown in FIG 1*b*, to form an integral check valve 420 attached to an oil drain outlet 425. Furthermore, unlike the separator 120 of the system 100 shown in FIG 1*b*, the filter/separator 410 is connected off-line. The filter/separator 410 has a foam filter 430 which filters the oily crankcase emission and separates the oil which is collected in an oil reservoir 440 located below the foam filter 430.

Such a crankcase emission control system 400 is manufactured by Diesel Research, the assignee of the present application and distributed by Parker Hannifin Corporation, Racor Division.

Several problems exist with current systems including low efficiency. For example, the oil separator 120 suffers from efficiency of less than 20%. This low efficiency has caused internal engine contaminations. Furthermore, the system 100 shown in FIG. 1*b*, is not an effective closed system. The vacuum limiting vacuum limiter 110 used in the closed system 100 either introduces outside air (requiring filtration) or bypass crankcase emissions to the atmosphere under high vacuum conditions effectively becoming an open system.

Another problem is finding room to locate the separate components of the prior art crankcase emission systems, such as the vacuum limiter 110, the control valve 415 and the separator/filter 120, 410 shown in FIGS. 1*a* and 4.

Compact packaging, while maintaining high efficiency, is a major consideration in crankcase emission control systems. Attempts have been made to reduce packaging size requirement by making an integral separator/air filter in a single unit such as the separator/filter 120, 410. However, separate components, i.e., the vacuum limiter 110, the control valve 415, and the separator/filter 120, 410, are used for pressure control and filtration. Having separate filtration and pressure control components not only present problems associated with packaging, i.e., finding space on the engine to locate them, but also result in higher cost of system parts and labor.

Existing inertial separators used in closed system, such as the system 100 shown in FIG. 1*a*, are of low efficiency, and barrier filters are of medium efficiency. Barrier filters, such as the coalescing filter 430 (FIG. 4), which are capable of filtering small particles, require a high pressure drop for proper filtration and clog quickly, thus requiring frequent replacement.

The determination of efficiency of the filter used in a closed system include the buildup of oil film in the aftercooler and the resultant deterioration in engine performance leading to premature engine overhaul. As oil film deposits in the aftercooler, the heat transfer rate from the compressed high temperature air to the water coolant decreases. As the air temperature to the engine proper increases, the full power capability of the engine decreases. Fuel efficiency reduction, control system and fuel injector fouling result from low efficiency filters.

A single flapper type valve, which opens to the atmosphere, not only requires a fresh air filter, with its associated loading effects, but also admits substantial diluted air to the emissions. This transforms a closed system into an open system and makes control through the necessary wide range of conditions difficult.

Thus, it is an object of the present invention to provide a closed crankcase emission control systems that is compact and combines various components into a single integrated unit, yet is efficient, simple and inexpensive to manufacture. It is another object of the present invention to provide a pressure control assembly that performs three functions, namely, regulating pressure, separating oil and agglomerating particles. It is a further object of the present invention to reduce the interval between changing filters, yet providing for efficient filtration. It is yet another object of the present invention to use the pressure drop across a pressure control mechanism to aid filtration combined with agglomeration and separation.

SUMMARY OF THE INVENTION

These and other objects are achieved by a closed crankcase emission control assembly according to the present invention wherein a pressure control assembly and a filter are integrated into a single compact unit. An oil drain check valve may also be incorporated into the single compact assembly. The inventive crankcase emission control assembly comprises a body located above a filter housing.

In an illustrative embodiment, the crankcase emission control assembly comprises a body connected to a filter housing. A first chamber, located in the body has a gas inlet which is connected to receive contaminated crankcase emissions. A second chamber, located around the first chamber, has a gas outlet which provides cleaned crankcase emissions to the engine air/combustion inlet. A channel extends from the first chamber toward the filter housing.

A pressure control assembly is located within the body and is configured to regulate pressure between the first chamber and the channel. A filter is located between the channel and the filter housing and a passageway to the second chamber, located between the filter and the filter housing, is connected to the second chamber. The crankcase emissions flow from the gas inlet to the gas outlet by flowing through the first chamber, the channel, the filter and the passageway. Illustratively, the gas inlet is substantially opposite the gas outlet.

The pressure control assembly is configured to agglomerate particles suspended in the contaminated crankcase emissions. The channel comprises a valve seat and the pressure control assembly comprises a valve located over the valve seat. A valve guide may be connected the valve and extends into the channel.

The valve and the valve seat define a variable orifice which is configured to accelerate the crankcase emissions passing therethrough so that small particles suspended in the crankcase emissions travel faster than large suspended particles. The small particles collide with the large particles and agglomerate to form larger particles which are filtered by the filter.

The portion of the valve defining the variable orifice is curved to form a gate which is configured to separate oil from the contaminated crankcase emissions when the contaminated crankcase emissions contact the gate or the valve while passing through the variable orifice.

In another illustrative embodiment, the inventive crankcase emission control assembly further comprises an oil outlet located at the bottom end of the filter housing, and an oil drain check valve connected to the oil outlet. The check valve is configured to allow oil to pass from the filter housing and to prevent both oil and gas from entering the filter housing.

An oil reservoir may be located between the filter and the oil outlet. The oil separated from the contaminated crankcase emissions collect in the oil reservoir.

Illustratively, the pressure control assembly also comprises a diaphragm having one side facing a chamber vented to the atmosphere and another side facing the first chamber, and a spring located around the valve. The spring biases the valve against a force created by a vacuum in the first chamber. The spring cooperates with the diaphragm to maintain a constant vacuum in the first chamber by causing the valve to move and vary the orifice formed between the valve and the channel.

The inventive closed crankcase emission control system provides a single compact integrated unit that operates efficiently and incorporates crankcase pressure regulation, inertial separation and agglomeration, and barrier filtration. The inventive closed crankcase emission control system agglomerates particles to form larger particles, thus reducing the interval between filter changes and allows improved filtration with less pressure drop. Furthermore, the inventive integrated compact unit regulates pressure to keep the crankcase pressure constant and collects the separated oil in a reservoir for periodic disposal or return to the oil pan.

BRIEF DESCRIPTION OF THE DRAWINGS

The present invention is described with reference to the following figures.

DETAILED DESCRIPTION OF THE INVENTION

Figure 5:
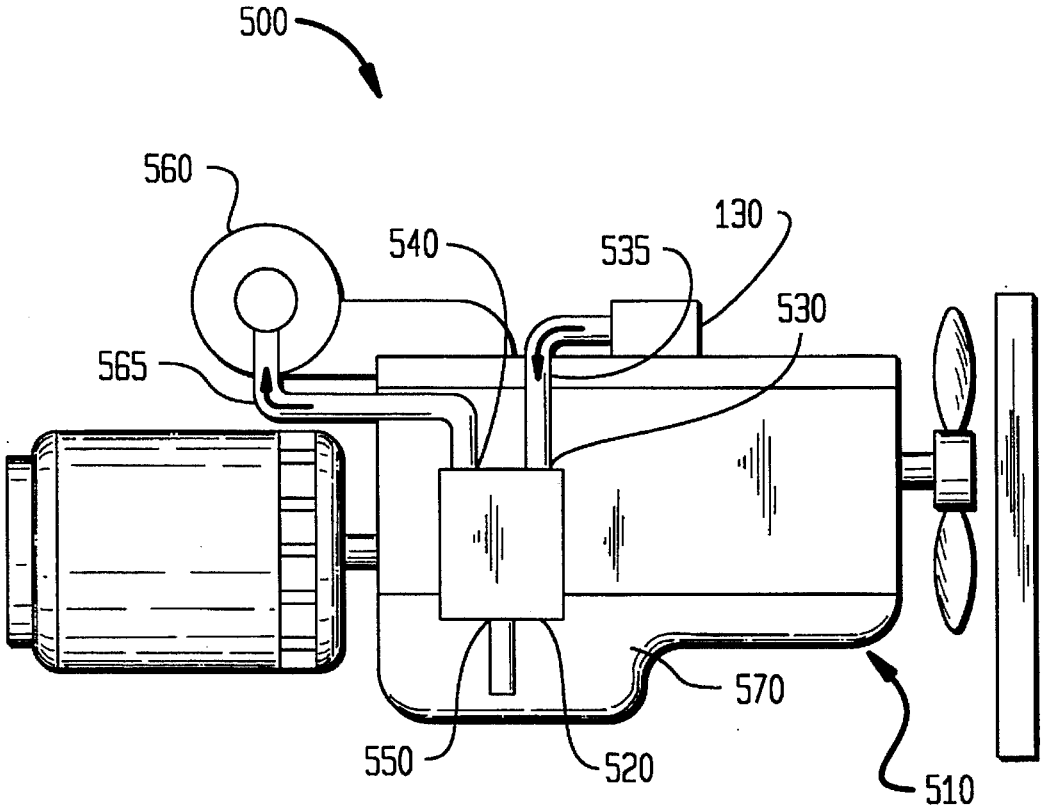
FIG. 5 illustrates an internal combustion engine having a closed crankcase emission control system according to the present invention.

FIG. 5 is an illustrative embodiment of the present invention. FIG. 5 shows a closed crankcase emission control system 500 comprising an internal combustion engine 510 and an integrated crankcase emission control assembly 520. The integrated crankcase emission control assembly 520 incorporates in a single compact unit a filter and a pressure control assembly, which simultaneously acts as a pressure regulator, an inertial separator and an agglomerator.

The crankcase emission control assembly 520 includes a gas inlet 530, a gas outlet 540 and an oil drain outlet 550. The gas inlet 530 is connected to the engine crankcase breather 130 via an inlet hose 535 and receives contaminated oily gas from the engine crankcase 140. The crankcase emission control assembly 520 separates the contaminated oily gas, agglomerates small particulates to form larger particulates and filters the large particulates.

The cleaned crankcase emissions exit from the gas outlet 540 and enter the engine air intake 560 for combustion via an outlet hose 565. The separated oil is collected in a reservoir at the bottom of the crankcase emission control assembly 520 for periodic disposal. Alternatively, for maintenance-free operation, the separated oil is returned to the oil pan 570 through a check valve (780 shown in FIG. 7*a*) connected to the oil drain outlet 550 and a drain hose 575.

Figure 1A:
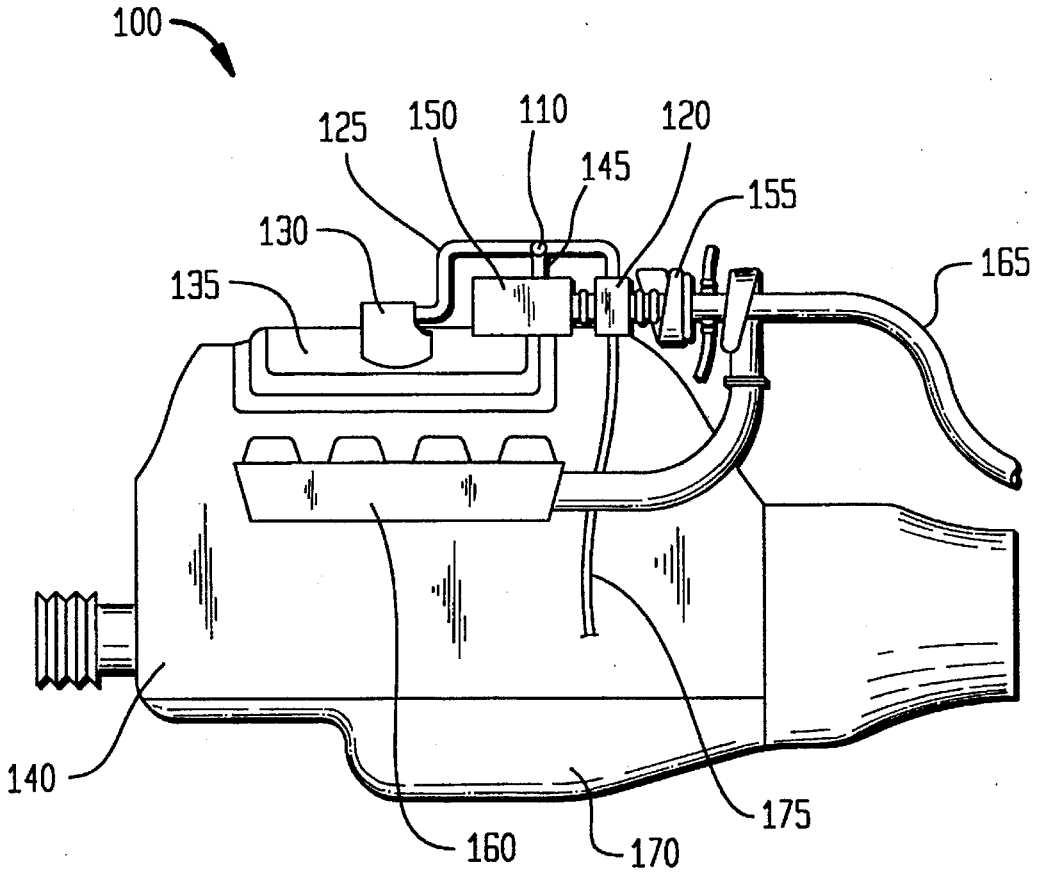
FIG. 1A (PRIOR ART)
FIG. 1*a* shows a prior art closed crankcase emission control system.
Figure 1B:
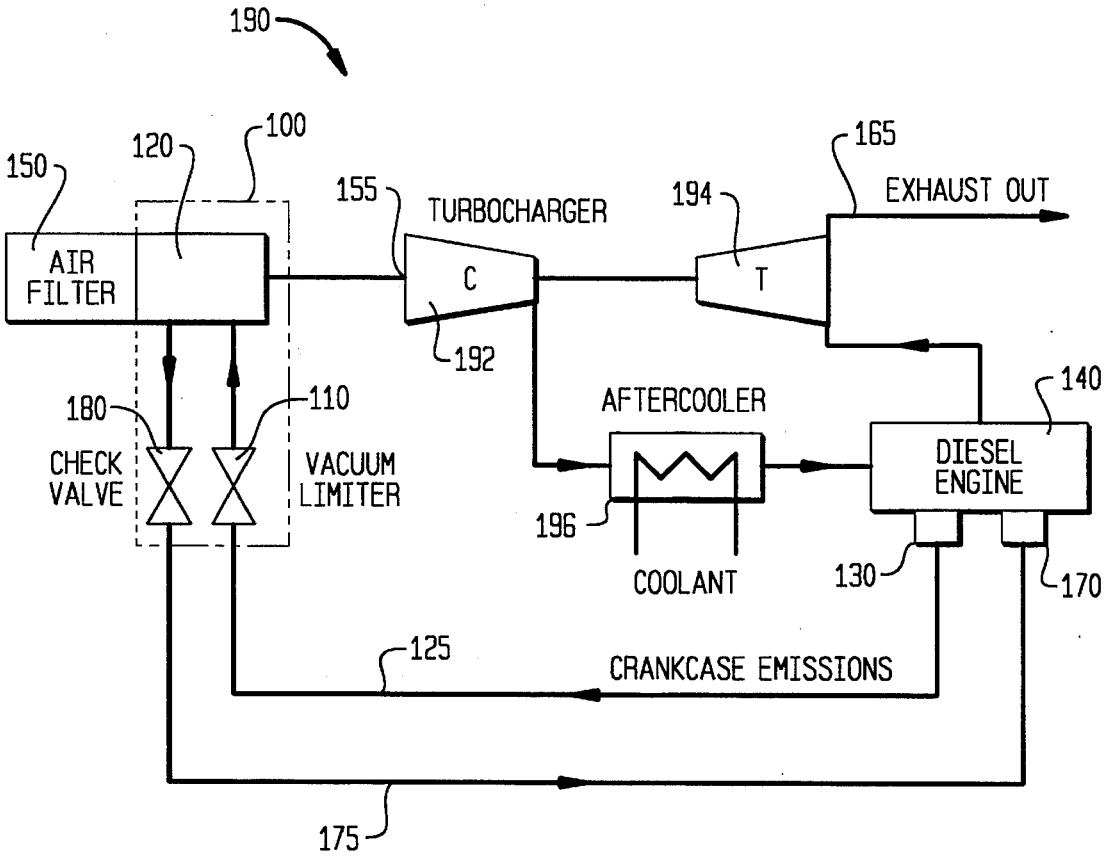
FIG. 1B (PRIOR ART)
FIG. 1*b* is a block diagram representation of the prior art crankcase emission control system shown in FIG. 1*a;*
Figure 2:
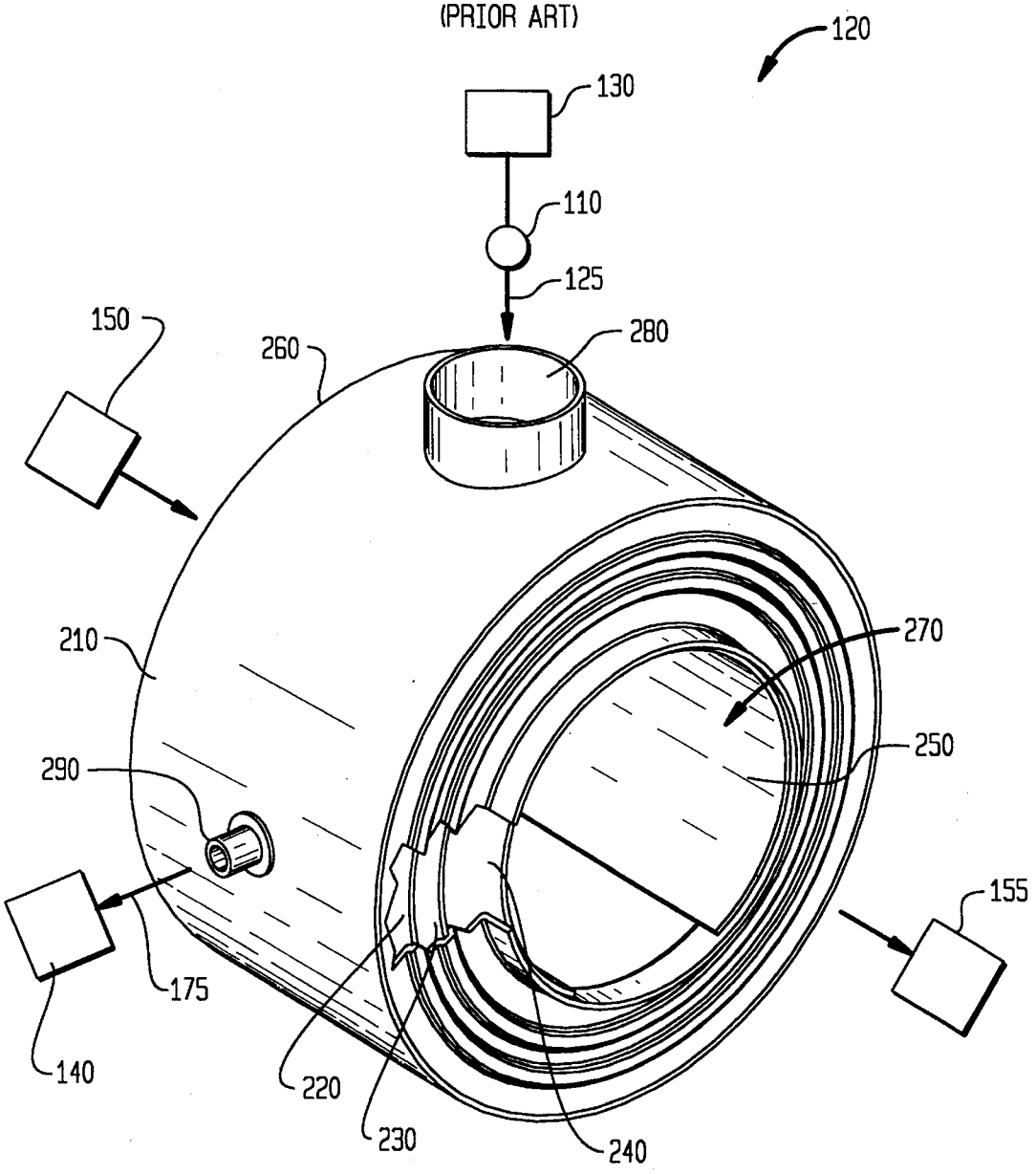
FIG. 2 (PRIOR ART)
FIG. 2 shows a prior art separator of FIG. 1*a* in greater detail.
Figure 3:
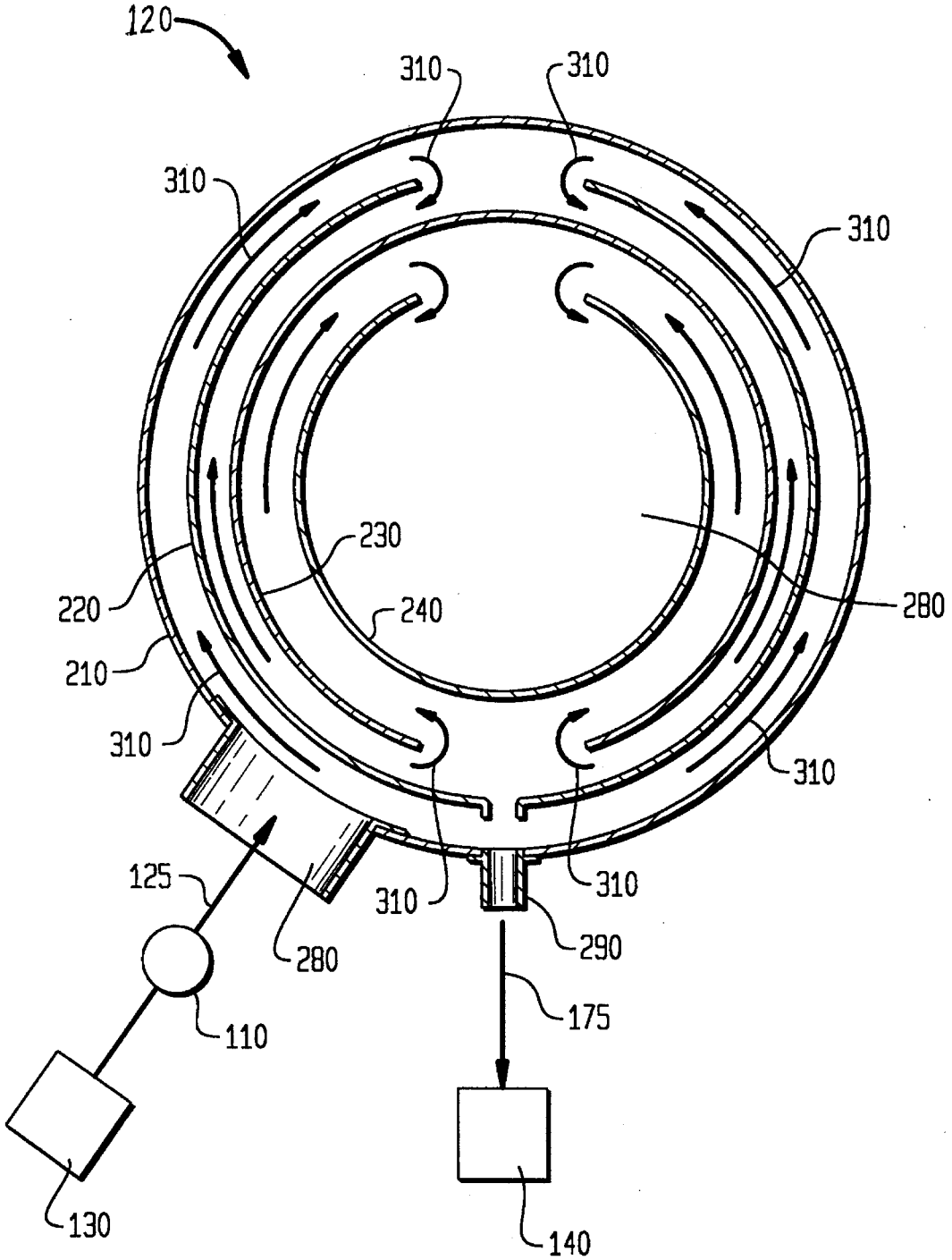
FIG. 3 (PRIOR ART)
FIG. 3 is a cross-sectional view of the prior art separator shown in FIG. 2.
Figure 4:
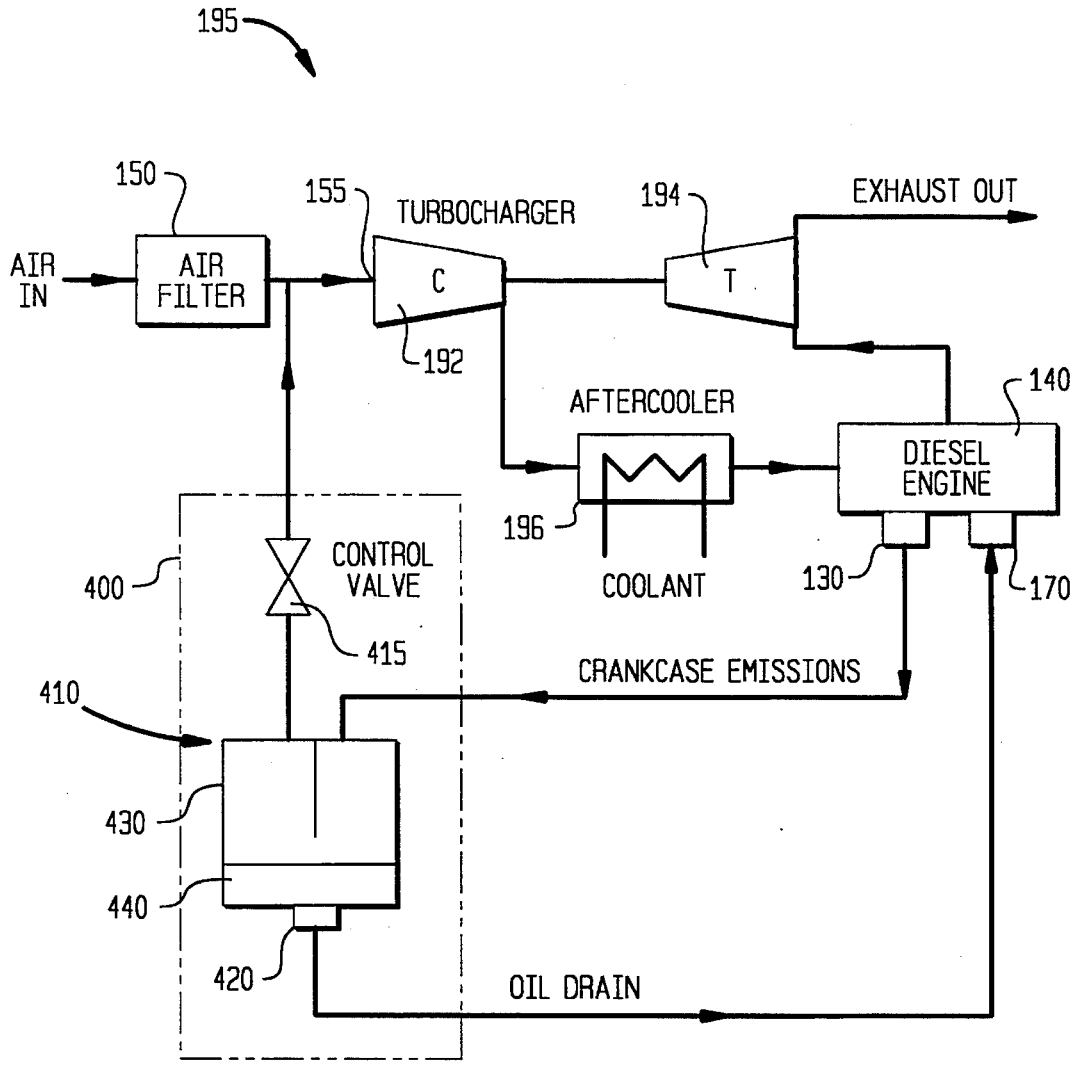
FIG. 4 (PRIOR ART)
FIG. 4 is a block diagram representation of another prior art closed crankcase emission control system.
Figure 6:
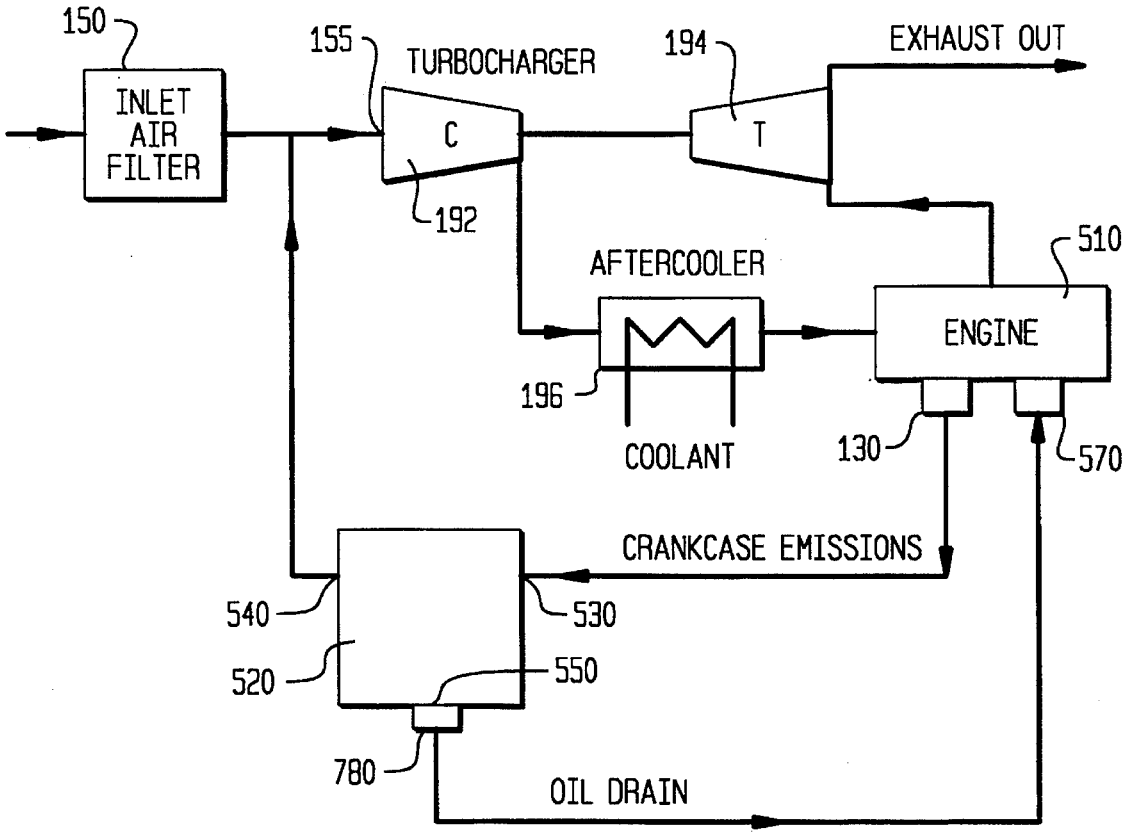
FIG. 6 is a block diagram representation of the closed crankcase emission control system according to the present invention shown in FIG. 5.

FIG. 6 is a block diagram representation of FIG. 5, wherein the cleaned crankcase emissions enter the intake air turbo 155 of a turbo-charged engine. The pressure control assembly (715 of FIG. 7*a*) of the crankcase emission control assembly 520 regulates pressure of the contaminated crankcase emission entering the gas inlet 530. The pressure control assembly keeps constant the pressure of the contaminated crankcase emissions entering the gas inlet 530. This alleviates the need to have the separate pressure vacuum limiter 110 and control valve 415 shown in FIGS. 1*b* and 4.

Figure 7A:
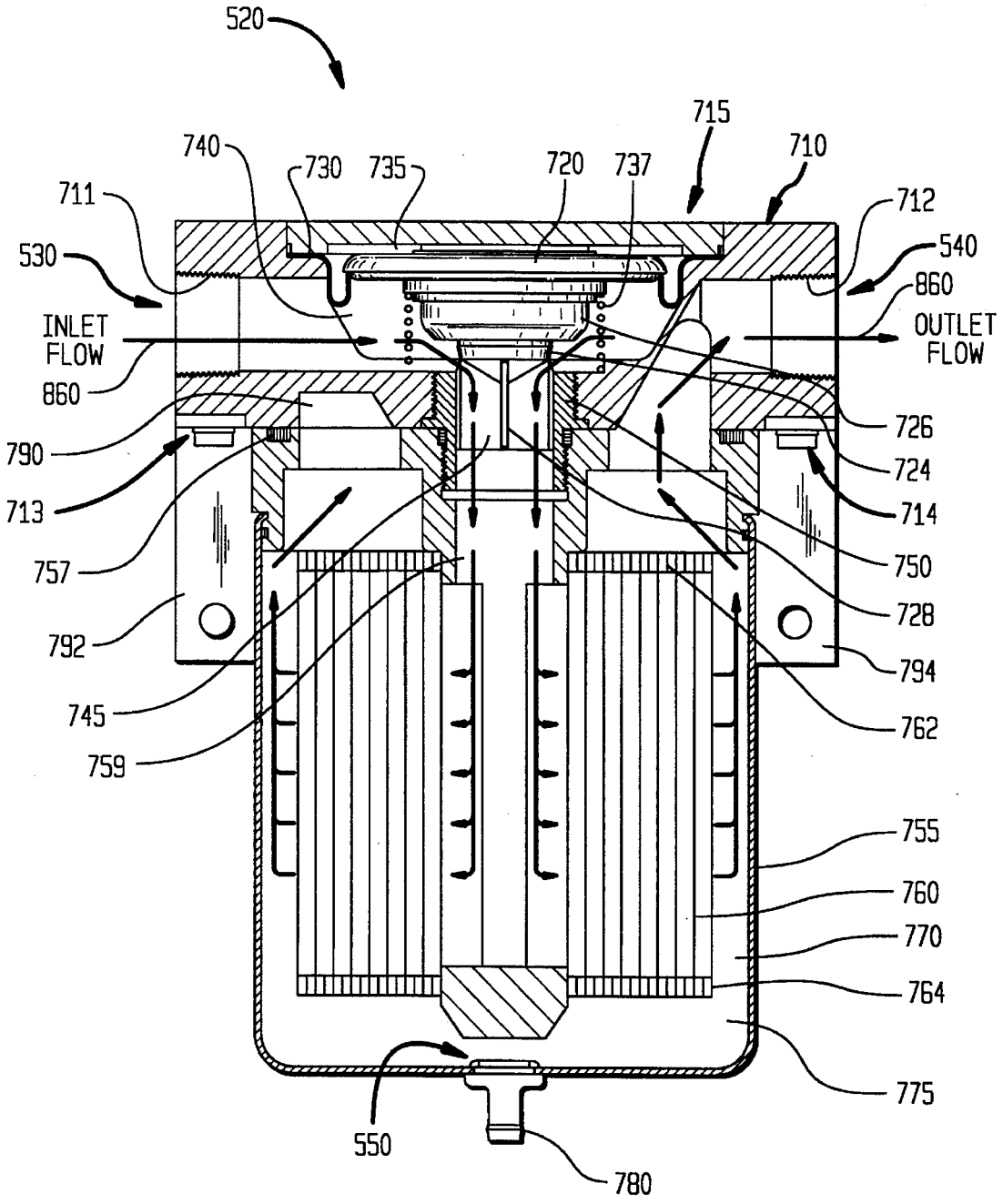
FIG. 7*a* shows a cross-sectional view of the crankcase emission control assembly according to the present invention shown in FIG. 5.

FIG. 7*a* shows a cross-section of the crankcase emission control assembly 520. The gas inlet 530 and gas outlet 540 are openings in a housing body 710 of the crankcase emission control assembly 520. Illustratively, the gas inlet 530 and gas outlet 540 may have threaded inner surfaces 711, 712, respectively. The gas inlet 530 and gas outlet 540 are located in an inlet neck 713 and outlet neck 714. The housing body 710 contains a pressure control assembly 715 which acts as a pressure regulator and an inertial separator and agglomerator.

The pressure control assembly 715 comprises a valve having a valve body 720 which is connected to a valve head 724. In turn, the valve head 724 is connected to a valve plug 726. A valve guide 728 is connected to the valve plug 726. An annular rolling diaphragm 730 is located circumferencially around the valve body 720 extending away therefrom. The diaphragm 730 separates the valve body 720 from an annular chamber 735 which is vented to the atmosphere. The vented annular chamber 735 is located above the valve body 720. A coil spring 737 is located around the valve plug 726, between the valve body 720 and a lower surface of an annular inlet chamber 740.

The inlet chamber 740 has an opening which is the gas inlet 530. In addition, an opening of a cylindrical body channel 745 is located at the center of the inlet chamber 740. The valve guide 728 is located within the body channel 745. Illustratively, the valve guide 728 comprises two crossing members having an X-shaped bottom (or top) view. However, different shaped valve guides may be used.

The opening of the body channel 745 is surrounded by a valve seat 750 which is opposite the valve plug 726. The valve seat 750, combined with the valve plug 726 and valve head 724, define a variable orifice 751 of an inertial separator and agglomerator.

Figure 7B:
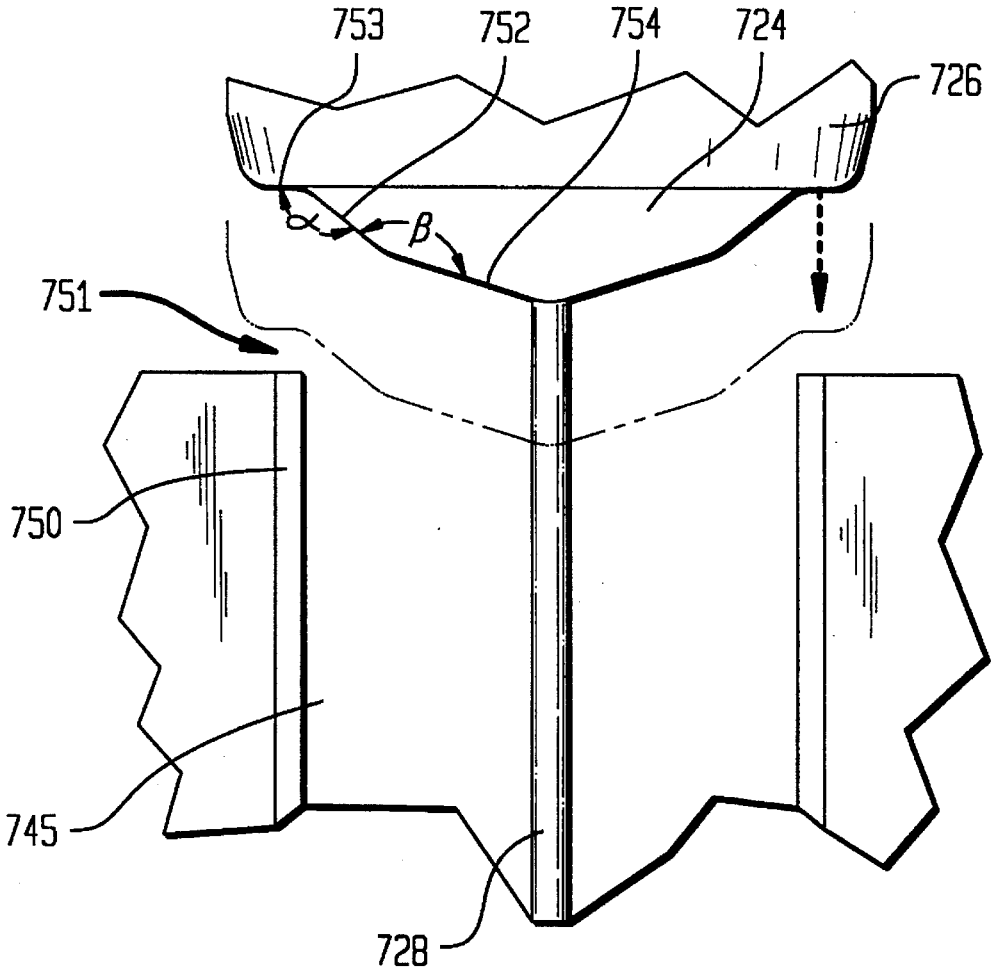
FIG. 7*b* shows in greater detail a valve of a pressure control assembly according to the present invention shown in FIG. 7*a;*

FIG. 7*b* is an enlargement of the valve seat 750 and valve head 724 showing the variable orifice 751 of the inertial separator and agglomerator in greater detail. The dotted lines show the valve head 724 pulled toward the valve seat 750 to decrease the variable orifice 751. As will be explained below, the variable orifice 751 acts as an agglomerator.

A gate 752 is formed between a nearly horizontal portion 753 of the valve plug 726 and a tapered head portion 754. The nearly horizontal portion 753 is located directly above the valve seat 750, and the tapered head portion 754 extends toward the body channel 745. In addition to functioning as an agglomerator, the gate 752 is designed to cause the pressure control assembly 715 to function as an inertial separator. For example, The gate 752 is steeply curved downward toward the body channel 745 and forms an angle $\alpha$ with the horizontal portion 753 and an angle $\beta$ with the tapered head portion 754. Illustratively, the angle $\alpha$ is approximately from 95° to 110° and the angle $\beta$ is approximately from 120° to 150°.

A filter housing 755 contains a barrier filter 760 and is located below the housing body 710. A gasket 757 is located between the housing body 710 and the filter housing 755. The body channel 745 mates with a channel 759 of the filter housing 755. The filter channel 759 is surrounded by the filter 760. Illustratively, the top and bottom endcaps 762, 764 of the filter 760 are impermeable.

A lateral annular gas passageway 770 is defined by a space between lateral sides of filter 760 and the filter housing 755. The space below the filter 760 and the filter housing 755 define an oil reservoir 775 having the oil drain outlet 550. An integral check valve 780 is attached to the oil drain outlet 550. Illustratively, the check valve 780 is a free floating check valve.

Figure 7C:
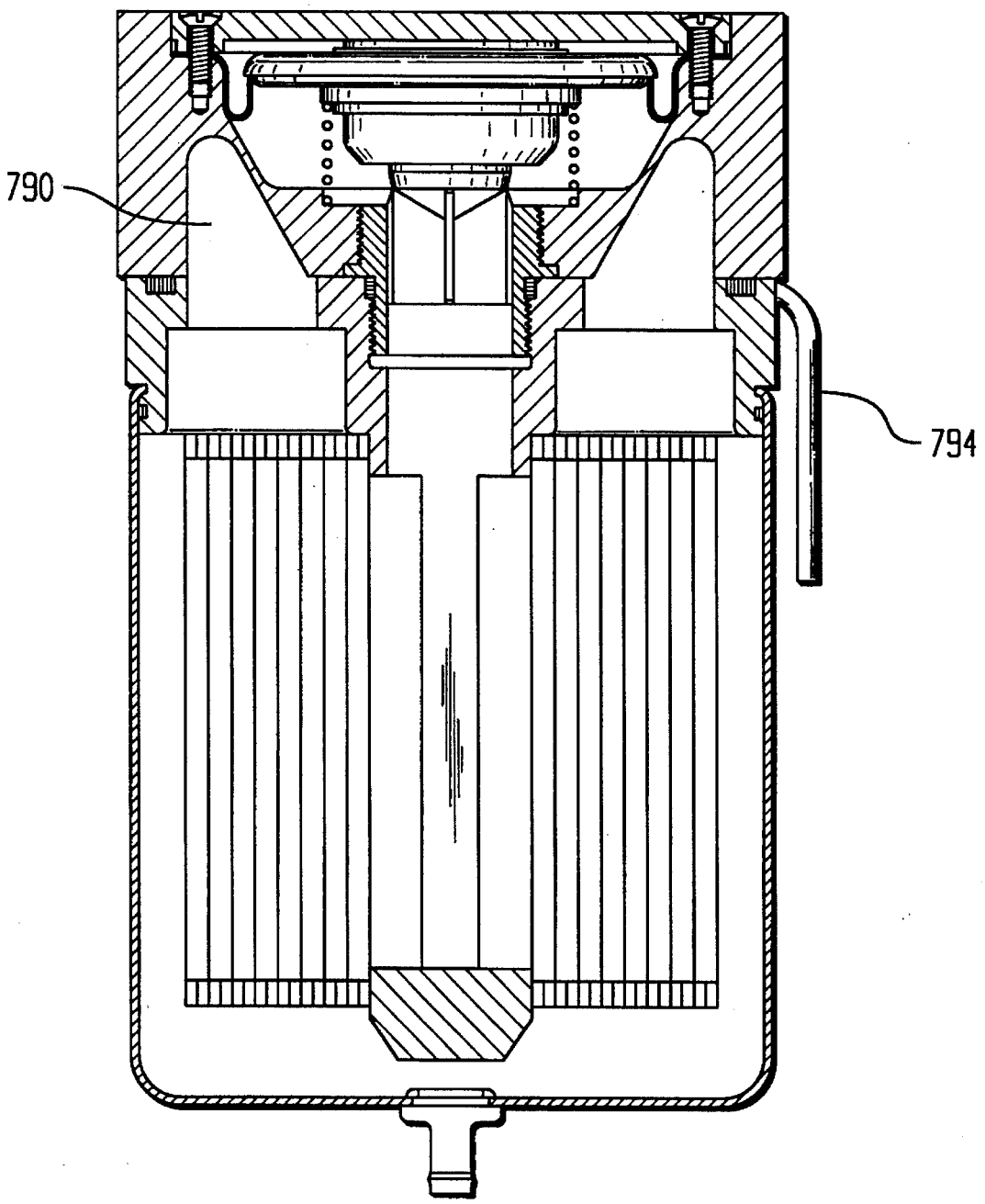
FIG. 7*c* shows a cross-sectional view of the crankcase emission control assembly according to the present invention shown in FIG. 7*a* rotated by 90°.

The passageway 770 is connected to an outlet chamber 790 which tapers up to surround the inlet chamber 740 and opens into the gas outlet 540 located within the outlet neck 714. Illustratively, the inlet and outlet necks 713, 714 are on opposite sides. Two brackets 792, 794 extend from the housing body 710 toward the filter housing 755. FIG. 7*c* shows the integrated crankcase emission control assembly 520 of FIG. 7*a* rotated by 90°.

Figure 8A:
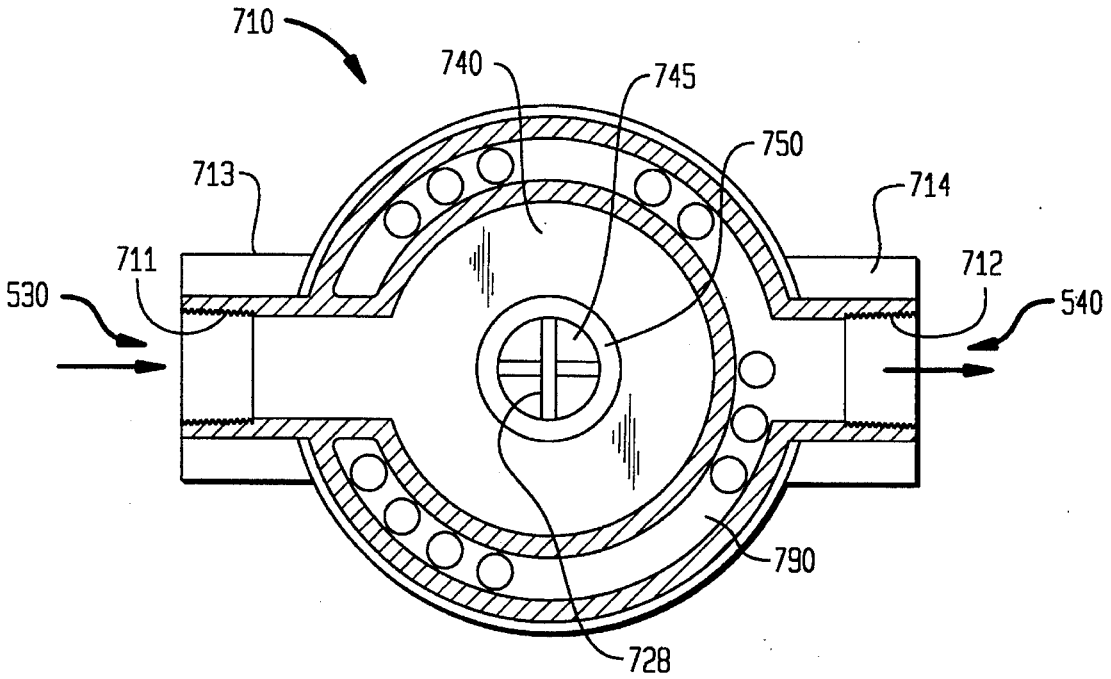
FIG. 8*a* is a top cross-sectional view of a housing body of the crankcase emission control assembly according to the present invention.
Figure 8B:
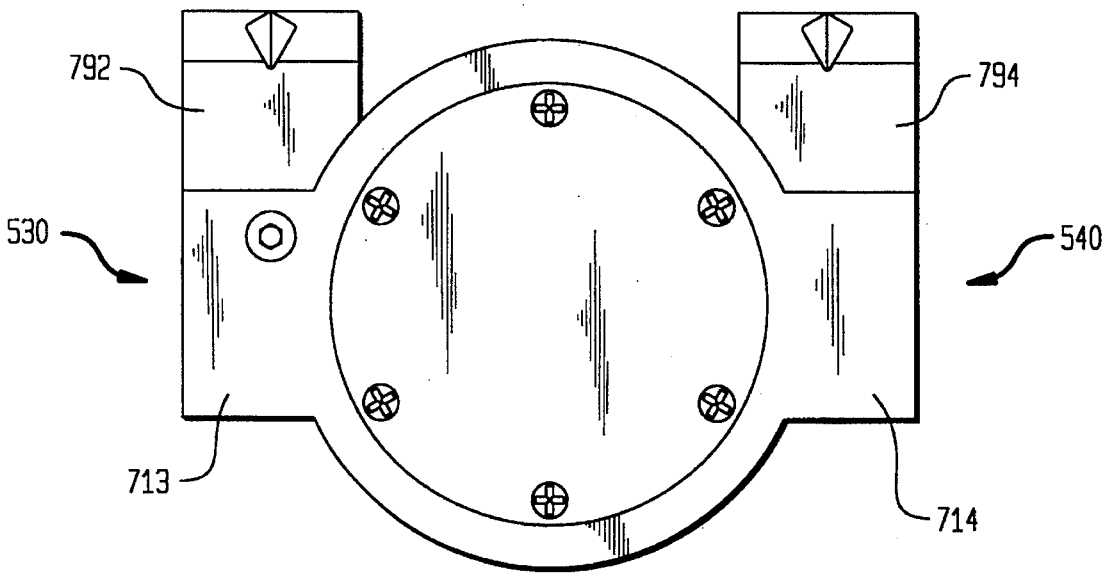
FIG. 8*b* is a top view of the integrated crankcase emission control assembly according to the present invention.

FIG. 8*a* is a top cross-sectional view of the housing body 710 showing the inlet neck 713 having the gas inlet 530 with the threaded inner surface 815. The gas inlet 530 opens into the inlet chamber 740 which has at its center the channel 745. The X-shaped valve guide 728 is shown inside the channel 745. FIG. 8*a* also shows the outlet neck 714 having the gas outlet 540 with the threaded inner surface 825. The outlet chamber 790, which opens into the gas outlet 540, is around the inlet chamber 740. FIG. 8*b* is a top view of the integrated crankcase emission control assembly 520 showing the housing body 710, the inlet and outlet necks 713, 714, and the brackets 792, 794.

Figure 9A:
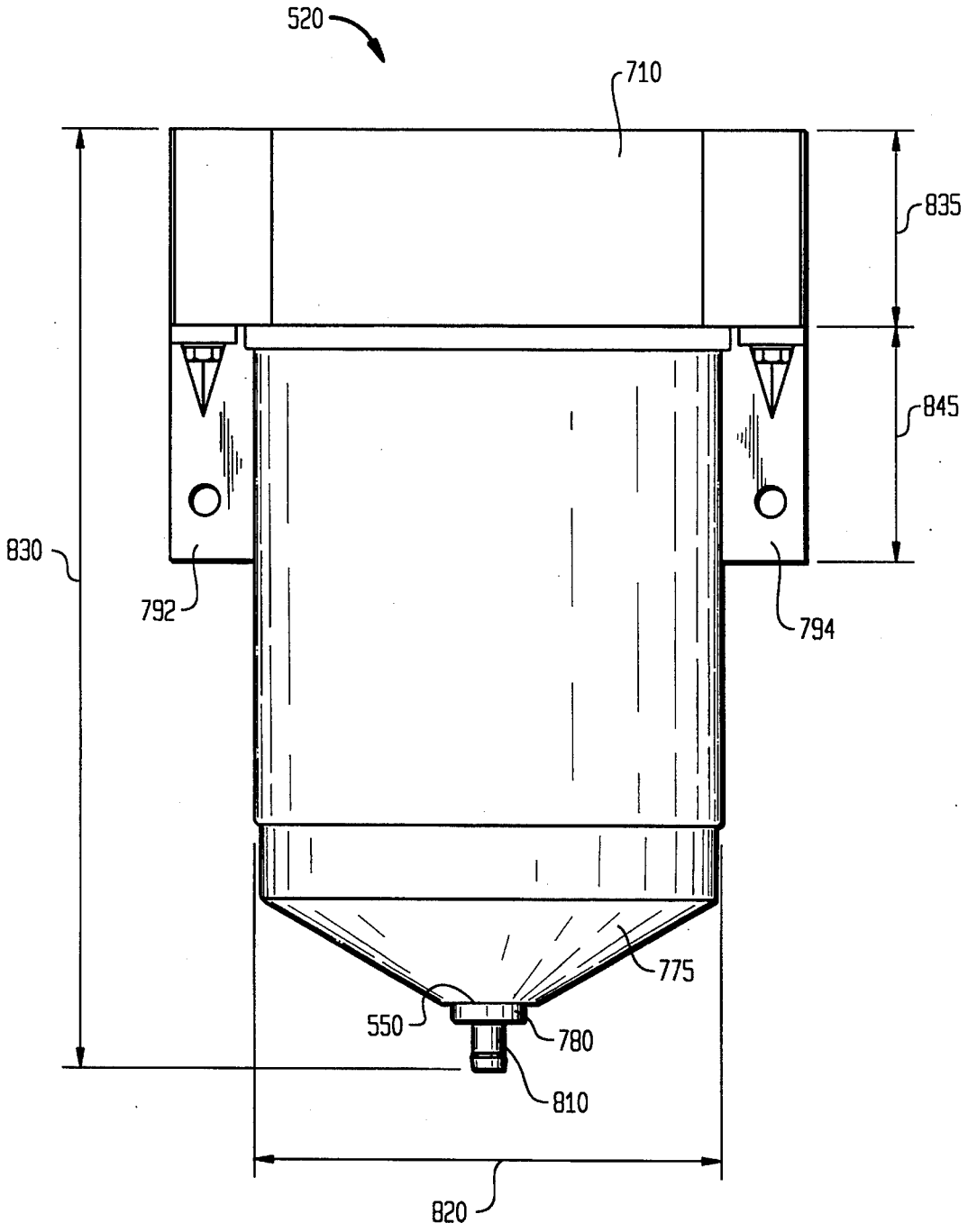
FIGS. 9*a* and 9*b* show two views of the crankcase emission control assembly according to the present invention rotated by 90°.
Figure 9B:
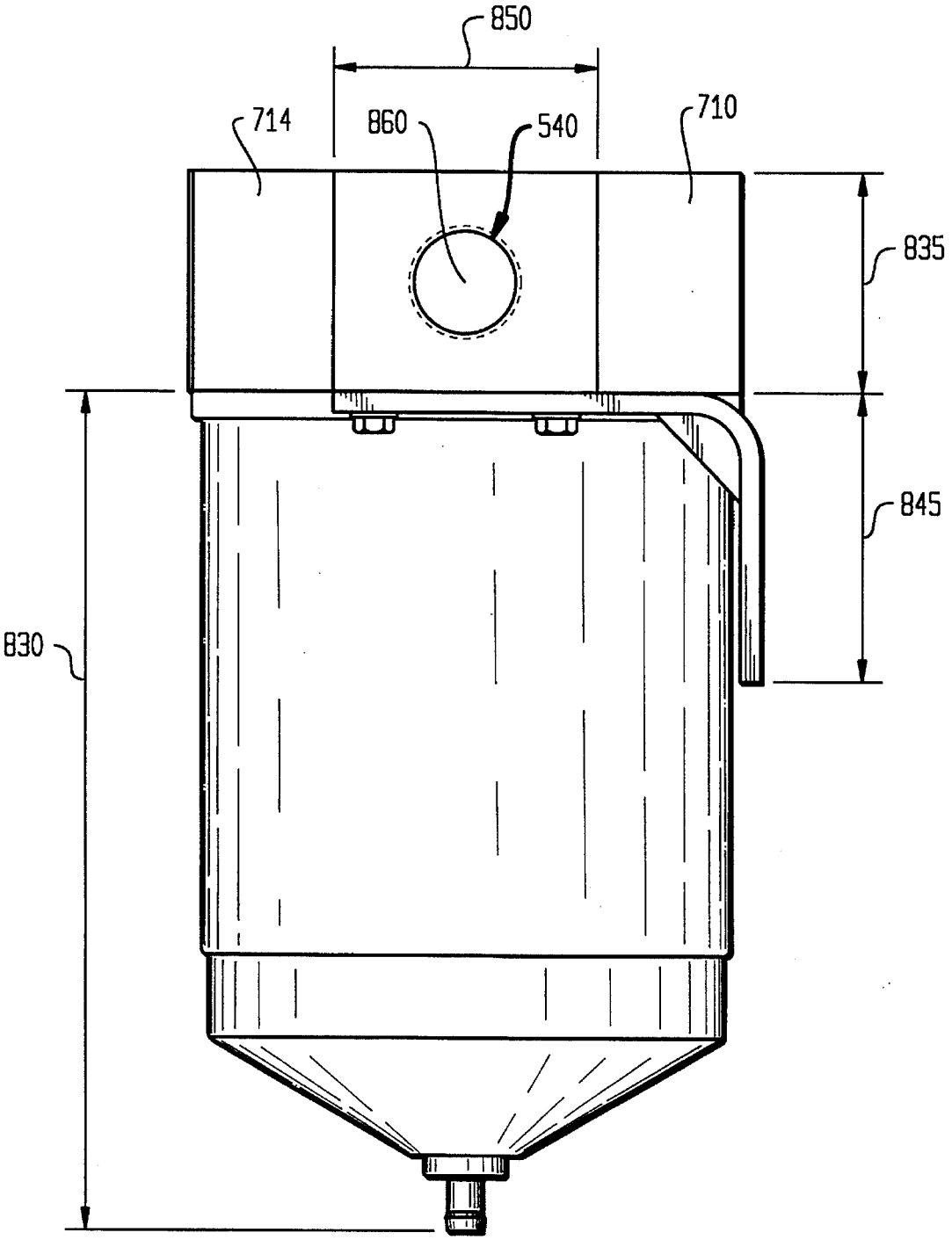

FIGS. 9*a* and 9*b* show two views of the integrated crankcase emission control assembly 520 of FIG. 7*a* rotated by 90°. Illustratively, the oil reservoir 775 is tapered toward the oil drain outlet 550 and a ⅜" hose barb protrudes from the integral check valve 780. The integrated crankcase emission control assembly 520 may have various sizes, depending on engine sizes and requirements. Illustratively, the width 820 of the filter housing 755 is approximately 4" to 7". The total length 830 of the integrated crankcase emission control assembly 520 is approximately 8" to 12", which is the sum of the length 835 of the housing body 710 and the length of the filter housing 755 is approximately 6.5" to 9.5". The brackets 792, 794, have a length 845 of approximately 1" to 3" and a thickness 850 (FIG. 8*b*) of approximately 0.125" to 0.5".

FIG. 8*b* shows the gas outlet 540 which is centered about the outlet neck 714. In turn, the outlet neck 714 is centered about the housing body 710. Illustratively, the outlet neck 714 has a width 850 of approximately 3". That is, the inlet and outlet necks 713, 714 are approximately 3" by 2.5", and the center 860 of gas outlet 540 (as well as the center of the gas inlet 530) is 1.25" from the top of the housing body 710. Illustratively, the diameter 860 of the gas outlet 540 (as well as the diameter of the gas inlet 530) is approximately 0.5" to 1".

Returning to FIG. 7*a*, illustratively, the body channel has a lower threaded surface to screw/unscrew the filter housing 755. Alternatively, the filter housing is held to the housing body 710 by clip-on brackets. To replace the filter 760, the filter housing 755 is unscrewed or unbracketed from the housing body 710 and the dirty filter removed from the filter housing 755. After inserting a new filter, the filter housing 755 is re-attached (bracketed or screwed) to the housing body 710. Alternatively, instead of exchanging filters, the entire filter housing 755, including the dirty filter, is exchanged with a new filter housing 755 containing a clean filter.

The integrated crankcase emission control assembly 520 operates as follows. Arrows 860 show the flow of crankcase emissions through the integrated crankcase emission control assembly 520.

The engine air intake 560 (FIG. 5) or the turbo air intake 155 (FIG. 6) of a turbo-charged engine, which is connected to the gas outlet 540, creates a vacuum in the outlet chamber 790. Illustratively, as the load or speed of the engine increases, a vacuum from 0" of water to −30" of water is created which persists in the outlet chamber 790, the filter housing 755, and the filter and body channels 759, 745.

The pressure control assembly 715 keeps the pressure in the inlet chamber 740 and engine crankcase constant. Illustratively, the vacuum in the inlet chamber 740 is maintained at a constant −2" ±2" of water. This is accomplished by the valve plug 726 moving, against the bias of the spring 737, to vary the size of orifice 751 (FIG. 7*b*) of the inertial separator and agglomerator formed by the valve seat 750 and the valve plug 726. By exchanging the spring 737 with a spring having a different tension, the crankcase pressure may be kept constant at a different pressure level.

The position of the valve head 724, or the size of the orifice 751 (FIG. 7*b*), depends on the pressure in the inlet chamber 740 which is created by pressure in the gas outlet 540. In a static position (i.e., no vacuum), the spring 737 keeps the valve head 724 away from the body channel 745. That is, in the static position, the orifice of the inertial separator and agglomerator is large. As the vacuum in the body channel 745 increases (or the pressure decreases) from 0" to −10" of water, the valve plug 726 moves toward the valve seat 750. Thus, the size of the orifice 751 (FIG. 7*b*) of the inertial separator and agglomerator decreases and pressure is dropped across the gate 752 so that a constant pressure in maintained in the inlet chamber 740.

As the oily contaminated emissions pass through the variable orifice, the gases pass through the sharp turn caused by the gate 752, while the oil in the emissions impinge against the gate 752. This coats the gate with oil thus separating a portion of the oil from the contaminated emissions. The separated oil travels along the tapered head portion 754, drips down the body and filter channels 745, 759, travels along the bottom endcap 764, and drips into the oil reservoir 775 through sides of the filter 760. The collected oil is either discarded or returned to the oil pan 570 (FIG. 5) through the check valve 780 and drain hose 550 (FIG. 5).

The check valve 780 allows separated oil to drain back to the crankcase, yet prevents flow of gases or oil back into the oil reservoir 775 of the filter housing 755. This prevents crankcase gases and oil from bypassing the filter 760 thus preventing engine damage.

The contaminated emissions accelerate as they pass through the variable orifice 751 (FIG. 7*b*). The smaller the size of the variable orifice 751 the larger the acceleration. Greater acceleration occurs as the engine speed or load increases, which decrease the size of the variable orifice 751. Small sized particulates accelerate more that larger sized ones. The fast traveling small sized particulates strike the slower traveling large particulates and coalesce or fuse together, i.e., agglomerate to form even larger sized particulates.

The crankcase emissions containing the agglomerated large sized particulates travel through the body and filter channels 745, 759, pass through the filter media 760 which filters out the particulates and any residual oil. Because the particulates are agglomerated into large sizes, a fine filter media capable of filtering smallest particulates is not needed for proper filtering. Instead, efficient filtering is obtained using a coarser filter media with less pressure drop. The coarser filter is less expensive than fine filters, clogs less often with, and requires less pressure drop for effective filtration. Thus, cost is reduced and maintenance intervals to replace the filter are increased. In addition, a large pressure drop for proper filtration is no longer required.

Particulate and oil free crankcase emissions leave the filter media 760 and exit from the gas outlet by passing through the passageway 770 and the outlet chamber 790. The cleaned crankcase emissions are then provided to the engine air intake 560 (FIG. 5) or the turbo air intake 155 (FIG. 6) for combustion.

In summary, the inventive integrated crankcase emission control assembly 520 incorporate into a single unit a pressure control assembly, a filter and an oil drain check valve. The single unit is compact, thus saving space and alleviating the need to have a separate pressure control valve.

Furthermore, the inventive pressure control assembly performs many functions. The inventive pressure control assembly, not only regulates pressure, but also acts as an inertial separator and agglomerator. The control valve simultaneously regulates pressure, separates oil and agglomerates particles in the crankcase emissions. Instead of relying on a centrifugal pattern, the inventive crankcase emission control system uses a combination of impingement, agglomeration, inertial impaction, diffusion, and direct interception to separate oil from the crankcase emissions. Thus, crankcase pressure is regulated, oil is separated from the contaminated crankcase emissions, and particles are agglomerated to large particles which are then easily filtered. The cleaned crankcase emissions are recycled through the combustion process.

The above described embodiment of the invention is intended to be illustrative only. Numerous alternative embodiments may be devised by those skilled in the art without departing from the spirit and scope of the following claims.

I claim:

1. A crankcase emission control assembly comprising:

a pressure control assembly having a gas inlet, a gas outlet, a gate and a channel located under the gate;

a filter housing connected to the pressure control assembly, wherein said channel extends into said filter housing; and a filter located within said filter housing, wherein the gate moves in relation to said channel so that pressure in the gas inlet is kept constant, oil is separated from emissions impinging against the gate, and particles in said emissions are agglomerated.

2. The crankcase emission control assembly of claim 1, wherein said channel comprises a seat, said gate and said seat defining a variable orifice.

3. The crankcase emission control assembly of claim 1 further comprising an oil outlet through the filter housing.

4. The crankcase emission control assembly of claim 3 further comprising an oil drain check valve connected to said oil outlet.

5. The crankcase emission control assembly of claim 4, wherein the check valve is configured to allow oil to pass from the filter housing and to prevent both oil and gas from entering the filter housing.

6. The crankcase emission control assembly of claim 4 further comprising an oil reservoir located between said filter and said oil outlet, wherein the separated oil drips into said oil reservoir.

7. The crankcase emission control assembly of claim 1 wherein the pressure control assembly comprises:

a diaphragm having one side facing a chamber vented to the atmosphere and another side facing the gas inlet;

a valve connected to the gate; and a spring located around the valve for biasing the gate against a force created by a vacuum in the gas inlet, said spring cooperating with said diaphragm to maintain a constant vacuum in the gas inlet by causing the gate to move and vary an orifice formed between the gate and the channel.

8. The crankcase emission control assembly of claim 7 further comprising a valve guide connected the valve and extending into the channel.

9. An internal combustion engine comprising:

an engine block with an engine breather having an outlet;

a crankcase emission control assembly comprising:

a pressure control assembly having a gas inlet, a gas outlet, a gate and a channel located under the gate;

a filter housing connected to the pressure control assembly, wherein said channel extends into said filter housing; and a filter located within said filter housing, wherein the gate moves in relation to said channel so that pressure in the gas inlet is kept constant, oil is separated from emissions impinging against the gate, and particles in said emissions are agglomerated; and an induction system coupled to the gas outlet for returning the cleaned crankcase emissions to the engine for combustion.

10. The crankcase emission control assembly of claim 9, wherein said channel comprises a seat, said gate and said seat defining a variable orifice.

11. A crankcase emission control assembly comprising:

a body having an outer wall, a top end and a bottom end;

a filter housing connected to the bottom end of the body;

a first chamber in the top end of the body having a gas inlet through the outer wall; said gas inlet being connected to receive contaminated crankcase emissions;

a second chamber located around the first chamber and having a gas outlet through the outer wall, said gas outlet being connected to output cleaned crankcase emissions;

a channel extending from the first chamber toward the filter housing;

a pressure control assembly located within said body and configured to regulate pressure between the first chamber and the channel;

a filter located between the channel and the filter housing; and a passageway between the filter and the filter housing connected to the second chamber;

wherein crankcase emissions flow from the gas inlet to the gas outlet by flowing through the first chamber, the channel, the filter and the passageway.

* * * * *